US008862018B2

(12) United States Patent
Suzuki et al.

(10) Patent No.: US 8,862,018 B2
(45) Date of Patent: Oct. 14, 2014

(54) CLEANING UNIT AND IMAGE FORMING APPARATUS USING THE SAME

(75) Inventors: Kazushi Suzuki, Suntou-gun (JP); Yoshimi Suzuki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 269 days.

(21) Appl. No.: 13/400,925

(22) Filed: Feb. 21, 2012

(65) Prior Publication Data

US 2012/0219315 A1 Aug. 30, 2012

(30) Foreign Application Priority Data

Feb. 25, 2011 (JP) ..... 2011-039547

(51) Int. Cl.
*G03G 15/16* (2006.01)

(52) U.S. Cl.
CPC ..... *G03G 15/161* (2013.01); *G03G 2215/1661* (2013.01)
USPC ..... 399/101; 399/71; 399/111; 399/49

(58) Field of Classification Search
USPC ..... 399/101, 111, 71, 159, 49
See application file for complete search history.

(56) References Cited

U.S. PATENT DOCUMENTS

| | | | | |
|---|---|---|---|---|
| 7,502,574 | B2 | 3/2009 | Suzuki et al. | |
| 2008/0304857 | A1* | 12/2008 | Yagi | 399/101 |
| 2010/0150602 | A1* | 6/2010 | Sano et al. | 399/101 |

FOREIGN PATENT DOCUMENTS

| | | | |
|---|---|---|---|
| JP | 2004-271603 | A | 9/2004 |
| JP | 2006-30358 | A | 2/2006 |
| JP | 2006-317663 | A | 11/2006 |
| JP | 2007-192987 | A | 8/2007 |

* cited by examiner

*Primary Examiner* — Walter L Lindsay, Jr.
*Assistant Examiner* — Roy Y Yi
(74) *Attorney, Agent, or Firm* — Fitzpatrick, Cella, Harper & Scinto

(57) ABSTRACT

An image forming apparatus includes an image bearing drum for carrying a toner image; an intermediary transfer member; a primary transfer device for primary transfer of a toner image from the drum onto the intermediary member; a secondary transfer device for secondary transfer of the toner image from the intermediary member onto a sheet; and a cleaning unit for removing the toner on the intermediary member. The cleaning unit includes a scraping member for removing the toner deposited on the intermediary member, an accommodating portion for the removed toner, a discharging member, provided downstream of the scraping member with respect to a moving direction of the intermediary member, for moving the toner in the accommodating portion to the intermediary member by application of a voltage, and a regulating member contacted to the discharging member to regulate an amount of the toner deposited on the discharging member.

14 Claims, 8 Drawing Sheets

CLEANING UNIT AND IMAGE FORMING APPARATUS USING THE SAME

FIELD OF THE INVENTION AND RELATED ART

The present invention relates to a cleaning unit for an image forming apparatus such as a copying machine, a printer, a facsimile machine or a complex machine, and an image forming apparatus using the cleaning unit.

As for a cleaning unit for an image forming apparatus, there is known a device which cleans an intermediary transfer member using a mechanical or electrostatic force.

As for the cleaning means using the mechanical force, there is known a cleaning blade (cleaning member) press-contacted to an intermediary transfer member with which the toner scraped off the intermediary transfer member is collected into a residual toner container provided in the image forming apparatus. As for the cleaning means using the electrostatic force, there is known a rotatable member having an electroconductive rubber layer supplied with a voltage by which the untransferred toner is electrostatically collected.

Japanese Laid-open Patent Application 2006-30358 discloses an apparatus which is provided with both of the cleaning blade as the cleaning member and the cleaning roller as the discharging member and in which the cleaning roller is provided upstream of the cleaning blade with respect to the rotational moving direction of the intermediary transfer member. The cleaning roller of the Japanese Laid-open Patent Application 2006-30358 is a rotatable member and is provided to move the untransferred toner to the intermediary transfer belt for the purpose of making it easy to collect the lubricant on the intermediary transfer member by the cleaning blade. The untransferred toner moved from the cleaning roller is collected by the cleaning blade from the intermediary transfer member together with the lubricant. With such a structure, Japanese Laid-open Patent Application 2006-30358 enhances surface energy of the intermediary transfer belt to suppress central void of the transferred image.

Japanese Laid-open Patent Application 2007-192987 discloses a cleaning unit for removing toner remaining on the surface of the photosensitive member not an intermediary transfer member in which a cleaning blade as a cleaning member and a brush as a rotatable member are provided, and the brush is disposed downstream of the cleaning blade with respect to the rotational moving direction of the photosensitive member. The brush functions to remove and retain the residual toner and to discharge the residual toner to the photosensitive member.

In Japanese Laid-open Patent Application 2007-192987, when the toner image is formed only on a part of the photosensitive members, the residual toner is discharged from the brush corresponding to the photosensitive member relatively upstream among the photosensitive members on which no toner image is formed, the removed toner is collected into a toner cartridge disposed relatively downstream. The collection into the toner cartridge is effected by scraping the toner off the surface of the photosensitive member by the cleaning blade contacted to the photosensitive member.

In Japanese Laid-open Patent Application 2006-30358, both of the cleaning blade and the rotatable member are provided, but the cleaning blade is placed downstream of the rotatable member with respect to the moving direction of the intermediary transfer member. Therefore, the toner from the rotatable member has to be removed by the cleaning blade, again. Then, a toner collection container for accommodating the toner removed by the cleaning blade is necessitated. In order to reduce the exchange frequency of the collection container, the size of the toner collection container may be increased, which, however, results in upsizing of the image forming apparatus, and on the other hand, in order to downsize the image forming apparatus, the size of the toner collection container may be reduced, which results in increase of the exchange frequency.

In Japanese Laid-open Patent Application 2007-192987, the residual toner produced in the toner cartridge positioned relatively upstream side is discharged and is collected into the toner cartridge positioned relatively downstream. With this structure, there is a possibility that the residual toner including foreign matter is collected into the downstream toner cartridge, which may lead to influence to the image. In addition, the residual toner including the foreign matter may pass by the developing roller of the downstream toner cartridge, there is a high liability that the developing roller not provided with cleaning means keeps carrying the foreign matter, and therefore, the liability of image defect increases further.

Particularly, since the intermediary transfer member is in contact with the transfer material in the secondary transfer portion, the intermediary transfer belt carries foreign matter such as paper dust, dust or fuzz. The foreign matter is easy to mix with the untransferred toner to move with the untransferred toner. Therefore, when the untransferred toner is discharged from the rotatable member, the foreign matter returns onto the intermediary transfer member and is finally collected into the toner cartridge. When the foreign matter is deposited on the photosensitive drum of the toner cartridge, an image defect may be produced.

For this reason, in a case that a cleaning blade and a discharging member are used in the cleaning unit, the amount of the foreign matter collected by the toner cartridge is large with the increased liability of the image defect.

SUMMARY OF THE INVENTION

Accordingly, it is an object of the present invention to provide an image forming apparatus where the increase of amount of the foreign matter collected by the toner cartridge is suppressed even when the cleaning blade and the discharging member are used for the cleaning device for the intermediary transfer belt, and therefore, the generation of the image defect can be suppressed.

According to an aspect of the present invention, there is provided an image forming apparatus comprising an image bearing member for carrying a toner image; a rotatable endless intermediary transfer member; primary transfer device for primary transfer of the toner image from said image bearing member onto said intermediary transfer member; a secondary transfer device for secondary transfer of the toner image from said intermediary transfer member onto a sheet; and a cleaning unit for removing the toner deposited on said intermediary transfer member; said cleaning unit including, a scraping member for removing the toner deposited on said intermediary transfer member from said intermediary transfer member, an accommodating portion for accommodating the toner removed by said scraping member, a discharging member, provided downstream of said scraping member with respect to a moving direction of said intermediary transfer member, for moving the toner accommodated in said accommodating portion to said intermediary transfer member by application of a voltage, and a regulating member contacted to said discharging member to regulate an amount of the toner deposited on said discharging member.

These and other objects, features, and advantages of the present invention will become more apparent upon consideration of the following.

DESCRIPTION OF THE PREFERRED EMBODIMENTS

The preferred embodiments of the present invention will be described in conjunction with the accompanying drawings. Here, the dimensions, the sizes, the materials, the configurations, the relative positional relationships of the elements in the following embodiments and examples are not restrictive to the present invention unless otherwise stated.

Figure 1:
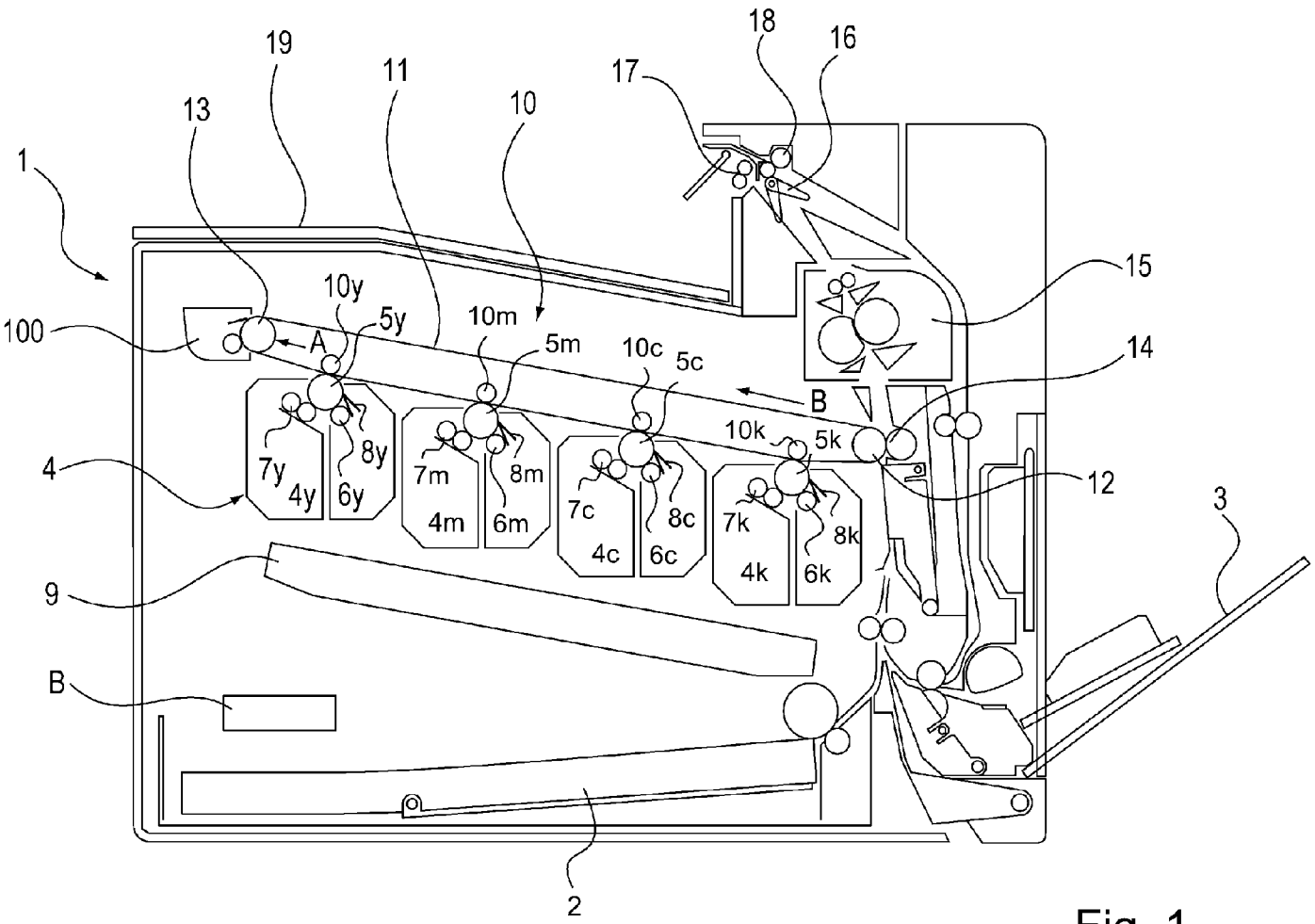
FIG. 1 is an illustration of an image forming apparatus according to a first embodiment.

Referring to the accompanying drawings, a cleaning unit and an image forming apparatus according to a first embodiment of the present invention will be described. FIG. 1 illustrates a general arrangement of the image forming apparatus 1 according to this embodiment.

The image forming apparatus 100 shown in FIG. 1 includes four process cartridges juxtaposed inclined relative to the horizontal direction. Each of the process cartridges 4 (4*y*, 4*m*, 4*c*, 4*k*) includes a photosensitive drum 5*y*, 5*m*, 5*c*, 5*k* as an image bearing member. The process cartridge 4*y*, the process cartridge 4*m*, the process cartridge 4*c* and the process cartridge 4*k* function form yellow toner image, magenta toner image, cyan toner image and black toner image, respectively.

The photosensitive drums 5*y*, 5*m*, 5*c*, 5*k* are rotated in a clockwise direction in FIG. 1 by unshown driving members. Around each of the photosensitive drums 5*y*, 5*m*, 5*c*, 5*k*, there are provided process devices 2, 3, 4, 5, 6 actable on the photosensitive drum, in the order named in the rotational moving direction thereof. The process devices include a charging roller 6 (6*y*, 6*m*, 6*c*, 6*k*) for uniformly charging a surface of the photosensitive drum 5*y*, 5*m*, 5*c*, 5*k*, a developing device 7 (7*y*, 7*m*, 7*c*, 7*k*), and a cleaning member 8 (8*y*, 8*m*, 8*c*, 8*k*) for removing the toner remaining on the surface of the photosensitive drum 1 after the transfer operation. In addition, the apparatus comprises scanner unit 9 for projecting a laser beam in accordance with the image information to form an electrostatic latent image on the photosensitive drum 5, and an intermediary transfer belt unit 10 as an intermediary transfer member for receiving the toner image from the photosensitive drum 1. The photosensitive drum 5, the charging roller 6, the developing device 7 and the cleaning member 8 are unified into a cartridge to constitute a process cartridge 4 detachably mountable relative to a mounting portion of the image forming apparatus.

The intermediary transfer belt unit 10 includes the intermediary transfer belt 11 movable along an endless path. The intermediary transfer belt 11 is supported by a driving roller 12 and a follower roller 13, and there is provided a primary transfer roller 10*y*, 10*m*, 10*c*, 10*k* (primary transfer device) inside the endless path of the intermediary transfer belt 11 and opposed to the photosensitive drum 5, wherein the primary transfer roller 10*y*, 10*m*, 10*c*, 10*k* is supplied with a transfer bias by the bias voltage application device (unshown).

Each photosensitive drum 5 rotates in the clockwise direction, and the intermediary transfer belt 11 rotates in the direction of an arrow B, and a positive bias voltage is applied to the primary transfer roller 10*y*, 10*m*, 10*c*, 10*k*, by which the toner images formed on the photosensitive drums 5 are transferred (primary transfer) onto the intermediary transfer belt 10 sequentially. In the state that the four color toner images are overlaid on the intermediary transfer belt 5, they are fed to a secondary transfer portion formed by the driving roller 12 and a secondary transfer roller 14 which is a secondary transfer device. On the other hand, the toner remaining on the surface of the photosensitive drum 5 after the toner image transfer is removed by the cleaning member 8 and is accumulated in a collection container.

In synchronism with the image forming operation, a sheet S as the recording material is fed from a feeding portion 2 or a manual insertion feeding portion 3 by a feeding device including a feeding device and a pair of registration rollers.

The fed sheet S is fed to the secondary transfer portion by the registration rollers. In the secondary transfer portion, the secondary transfer roller 14 is supplied with a positive bias voltage so that the four color toner images are transferred (secondary transfer) from the intermediary transfer belt 5 onto the fed sheet S.

The toner remaining on the intermediary transfer belt 5 after the secondary transfer to the sheet S is removed by a belt cleaning unit 23 which is the cleaning unit. The belt cleaning unit 23 will be described hereinafter in detail. On the other hand, a fixing device 15 applies heat and pressure to the toner image formed on the sheet S to fix the toner image on the sheet. The sheet S carrying the unfixed toner image fed from the image forming station is heated and pressed by the fixing nip of the fixing device 15 by which the unfixed toner image on the sheet S is fixed. Thereafter, the sheet S is discharged onto the stacking portion 19 by a pair of discharging rollers. In the case of duplex image formation (the images are formed on both sides of the sheet), the sheet S is reversed by a pair of switch-back rollers 18, and is fed to the image forming station, and is passed through the fixing device 15, and is finally discharged to the stacking portion 19.

(Toner Cleaning Device 100)

Figure 2:
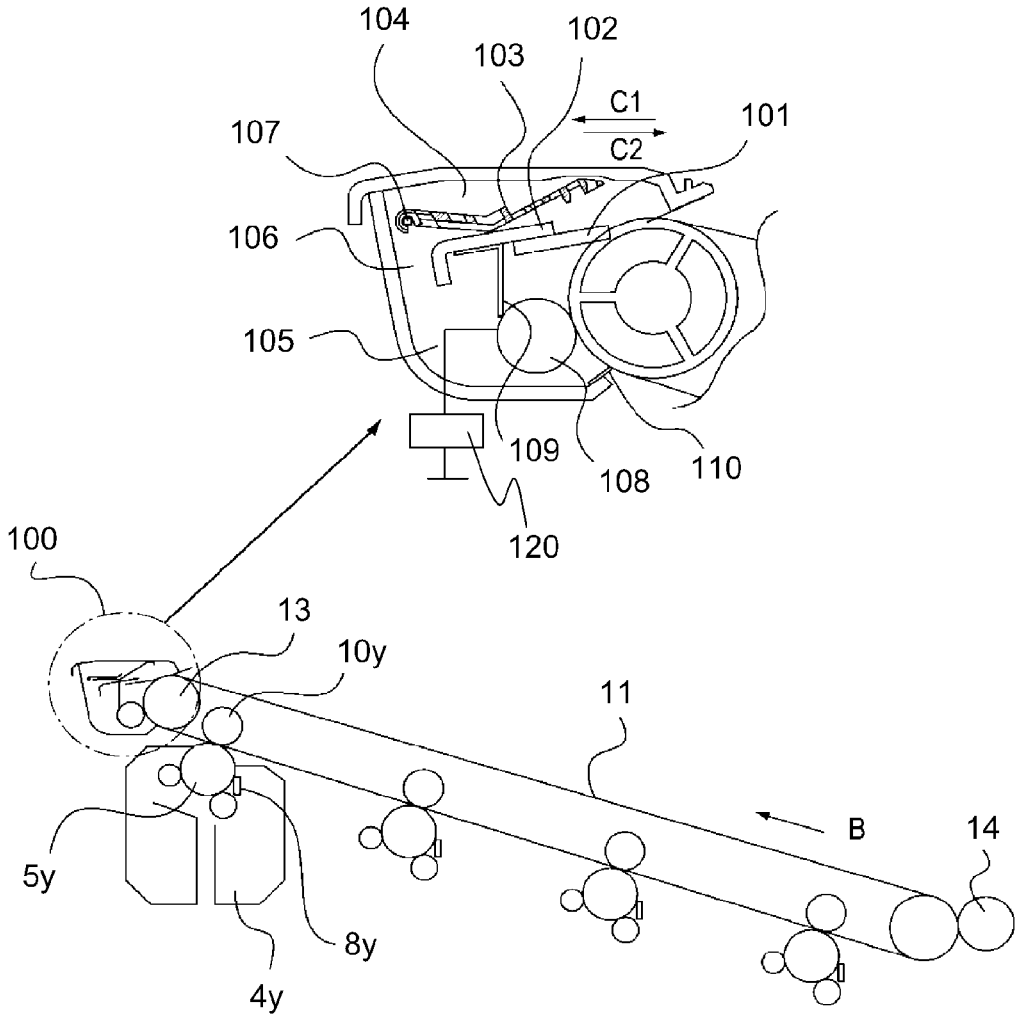
FIG. 2 is an illustration of the cleaning unit according to the first embodiment.

FIG. 2 illustrates the toner cleaning unit 100. As shown in FIG. 2, the toner cleaning device 100 is disposed upstream of the upstreammost one of the primary transfer portions and downstream of the secondary transfer portion with respect to the moving direction (arrow B in FIG. 2) of the intermediary transfer belt 11. The primary transfer portion placed upstreammost position is formed by the photosensitive drum 5*y* and the primary transfer roller 10*y*.

The toner cleaning device 100 comprises a cleaning blade (separating member) 101, a holding member 102, toner feeding member 103, accommodating portion 105, a discharging member (discharge member) 108, a toner regulating member 109, and a leakage preventing sheet 110.

The cleaning blade 101 is a plate-like member of deformable elastic rubber (elastic member), and is bonded to the holding member 102 of a metal plate. The cleaning blade 101 has a width not less than a width of the LTR size measured in the direction perpendicular to the moving direction of the intermediary transfer belt 11, and is effective to remove the untransferred toner from the intermediary transfer belt 11 by press-contacting to the intermediary transfer belt 11. The cleaning blade 101 is press-contacted to the follower roller 13. It is general that the cleaning blade 101 is press-contacted to various rollers provided inside the intermediary transfer belt 11 to provide a desired line pressure capable of removing the untransferred toner.

In this embodiment, when the image formation is carried out, the toner is charged to the negative polarity. Therefore, for the primary transfer and the secondary transfer, a voltage of polarity which is opposite the charge polarity toner is applied. At the time of the primary transfer and the secondary transfer, a small amount of the toner is charged to the positive property, but most of the untransferred toner remaining on the intermediary transfer belt 11 after the secondary transfer remains charged to the negative polarity.

The untransferred toner scraped off the intermediary transfer belt 11 by the cleaning blade 101 is moved in the toner feeding path 104 by the toner feeding member 103. The falls along the groove 106 formed by the frame of the toner cleaning device 100 and the holding member 102 into the accommodating portion 105.

The toner feeding member 103 is disposed in the accommodating portion and is in the form of lattice. It is supported by a shaft 107 which rotates eccentrically. Since the shaft 107 is rotated with eccentricity, the toner feeding member 103 as a whole reciprocates in the directions of arrow C1 and arrow C2 in FIG. 2. During the forward movement stroke, the toner feeding member 103 moves substantially horizontally along the bottom surface of the toner feeding path 104, by which the untransferred toner is fed in the direction of the arrow C1 in FIG. 2. During the returning movement stroke, the toner feeding member 103 rises away from the bottom surface of the toner feeding path 104 angularly upwardly, by which it is away from the untransferred toner so as not to return the toner toward the cleaning blade 101.

The discharging member 108 is disposed downstream of the cleaning blade 101 with respect to the moving direction of the intermediary transfer belt 11. When a certain amount of the untransferred toner is accommodated in the accommodating portion 105, the untransferred toner starts contacting the discharging member 108. The discharging member 108 includes a rotatable roller driven by the movement of the intermediary transfer belt 11 and is rotated in the direction indicated by the arrow the clockwise direction). Thereafter, the discharging member 108 is supplied with the bias voltage of the same polarity as the bias voltage applied to the primary transfer roller 10*y*, from a cleaning power source 120. In this embodiment, the regular charge polarity of the toner is negative. By the application of the voltage from the cleaning power source 120, the electric discharge is effected to untransferred toner so that the untransferred toner is charged to the positive polarity.

If the secondary transfer voltage is increased in an attempt to optimize the transferring performance under a high humidity ambience, for example, the charge polarity of the untransferred toner may be unstable. Even in such a case, by the electric discharge with the positive voltage apply to the discharging member 108, the untransferred toner deposited on the surface of the discharging member 108 can be assuredly charged to the positive polarity of the respective of whether the untransferred toner is charged to the positive polarity or the negative polarity. So, the discharging member 108 is called charging roller 108 in the following.

The untransferred toner reverted in the polarity from the negative polarity to the positive polarity is moved to the intermediary transfer belt 11 by the potential difference between the charging roller 108 and the electrically grounded follower roller 13. The untransferred toner moved to the intermediary transfer belt 11 from the charging roller 108 is moved to the photosensitive drum 5*y* by the potential difference between the positive bias voltage applied to the primary transfer roller 10*y* and the surface of the photosensitive drum 5*y* charged to the negative polarity by the charging device 6*y*. Thereafter, the toner is scraped off by the photosensitive member cleaning blade 8*y* contacted to the photosensitive drum 5*y* and is collected into the toner cartridge 4*y*.

The toner regulating member 109 is contacted to the surface of the charging roller 108 to apply the untransferred toner uniformly on the charging roller 108. By regulating the thickness of the toner layer on the charging roller 108 in this manner, it is avoided that a large amount of the untransferred toner is discharged onto the intermediary transfer belt 11. The toner regulating member 109 is made of metal and is fixed on the holding member 102 to press against the charging roller 108 at a predetermined pressure.

On the intermediary transfer belt 11, there is foreign matter such as paper dust removed from the sheet, dust and/or fuzz or the like, as well as the untransferred toner. Such foreign matter is mixed in the untransferred toner and is collected by the cleaning blade 101 and fed into the accommodating portion 105 and is deposited on the charging roller 108. However, when the toner regulating member 109 uniforms the untransferred toner on the discharging member 108 into a thin layer, such foreign matter is removed from the charging roller 108 so as to prevent it from discharging onto the intermediary transfer belt 11.

In addition, a preventing sheet 110 is provided between the toner cleaning device 100 and the intermediary transfer belt 11 and is lightly contacted to the intermediary transfer belt 11. By doing so, the untransferred toner is prevented from leaking from the accommodating portion 105.

In addition, the follower roller 13 and the charging roller 108 are connected through a gear (unshown) so that the charging roller 108 is rotated by the follower roller 13. Therefore, the intermediary transfer belt 11 (follower roller 13) and the charging roller 108 rotate at the same speed. Thus, the uniform and thin layer of the untransferred toner can be discharged stably onto the intermediary transfer belt 11.

Figure 3:
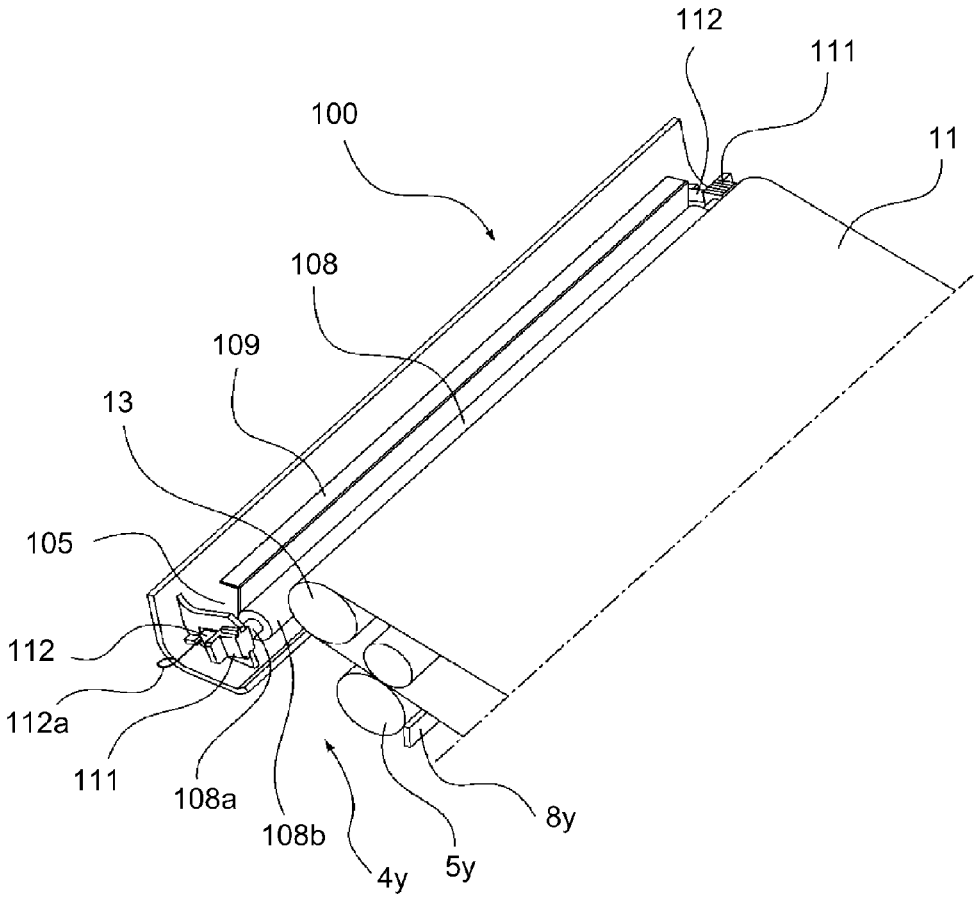
FIG. 3 is a perspective view of a discharging member and parts therearound.

FIG. 3 is a perspective view of charging roller 10 and the parts therearound. As shown in FIG. 3, the charging roller 108 comprises a metal core metal 108*a* and an electroconductive rubber layer and is rotatably supported by bearings 111 of resin material at the opposite ends. At least one of the bearings 111 is made of electroconductive resin material.

The bearing 111 is urged toward the follower roller 13 by a spring 112, by which the charging roller 108 and the intermediary transfer belt 11 are contacted to each other at a desired pressure. Since the charging roller 108 is urged at the opposite ends, the charging roller 108 is pressed against the intermediary transfer belt 11 uniformly in the longitudinal direction.

In addition, the spring 112 has a function of an electrical contact, and by contacting contact portion 112*a* to a contact (unshown) provided in the main assembly side of the image forming apparatus, bias voltage can be applied to the spring 112. When the bias voltage is applied to the spring 112 from the cleaning power source 120, the bias voltage is applied to the 108*b* of the charging roller 108 through the electroconductive bearing 111.

Figure 4:
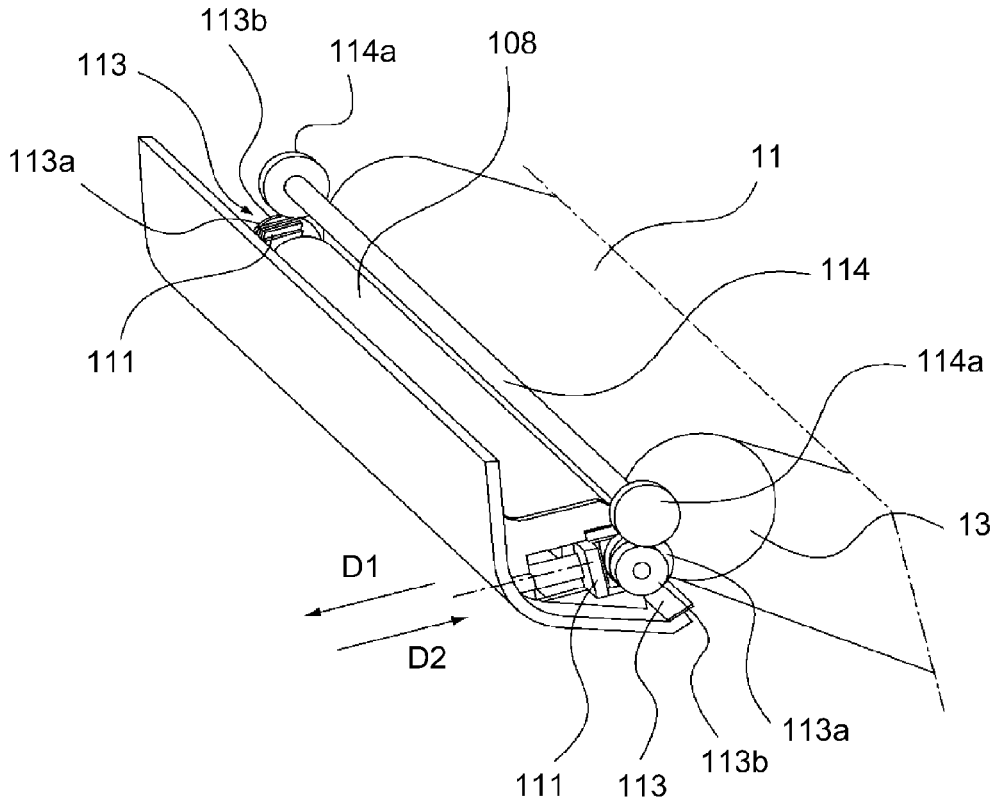
FIG. 4 is an illustration of a structure for contacting and spacing between the discharging member and the intermediary transfer member.

FIG. 4 is an illustration of the structure for the contacting and spacing between the charging roller 108 and the intermediary transfer belt 11. As shown in FIG. 4, a spacer member 113 is provided adjacent the bearing 111 supporting the charging roller 108. The spacer member 113 is provided with integral cam 113*a* and gear 113*b*. The cam 113*a* functions for the contacting and spacing between the charging roller 108 and the intermediary transfer belt 11.

Each of the ends of a driving shaft 114 provided above the charging roller 108 is provided with a gear 114*a* so that the driving shaft 114 and the gear 114*a* are rotated by a motor ((unshown)) provided in the main assembly of the image forming apparatus. By transmission of the rotational drive from the gear 114*a* to the gear 113*b*, the cam 113*a* is rotated so that the bearing 111 slides in the directions of an arrow D1 and an arrow D2.

When the bearing 111 moves in the direction of arrow D1, the charging roller 108 and the intermediary transfer belt 11 are spaced from each other. When the bearing 111 moves in the direction of arrow D2, the charging roller 108 and the intermediary transfer belt 11 are contacted to each other.

In this embodiment, the charging roller 108 is spaced from the intermediary transfer belt 11 by the amount corresponding to non-plastic deformation of the toner regulating member 109, particularly the amount is 0.5-1 mm in this embodiment. The untransferred toner on the intermediary transfer belt 11 is removed by cleaning blade 101. Therefore, when the contacting and spacing of the charging roller 108 relative to the intermediary transfer belt 11, the untransferred toner can be discharged to the intermediary transfer belt 11 selectively at any timing.

(Collection of the Untransferred Toner in Toner Cartridge 4*m*-4*k*)

Figure 5:
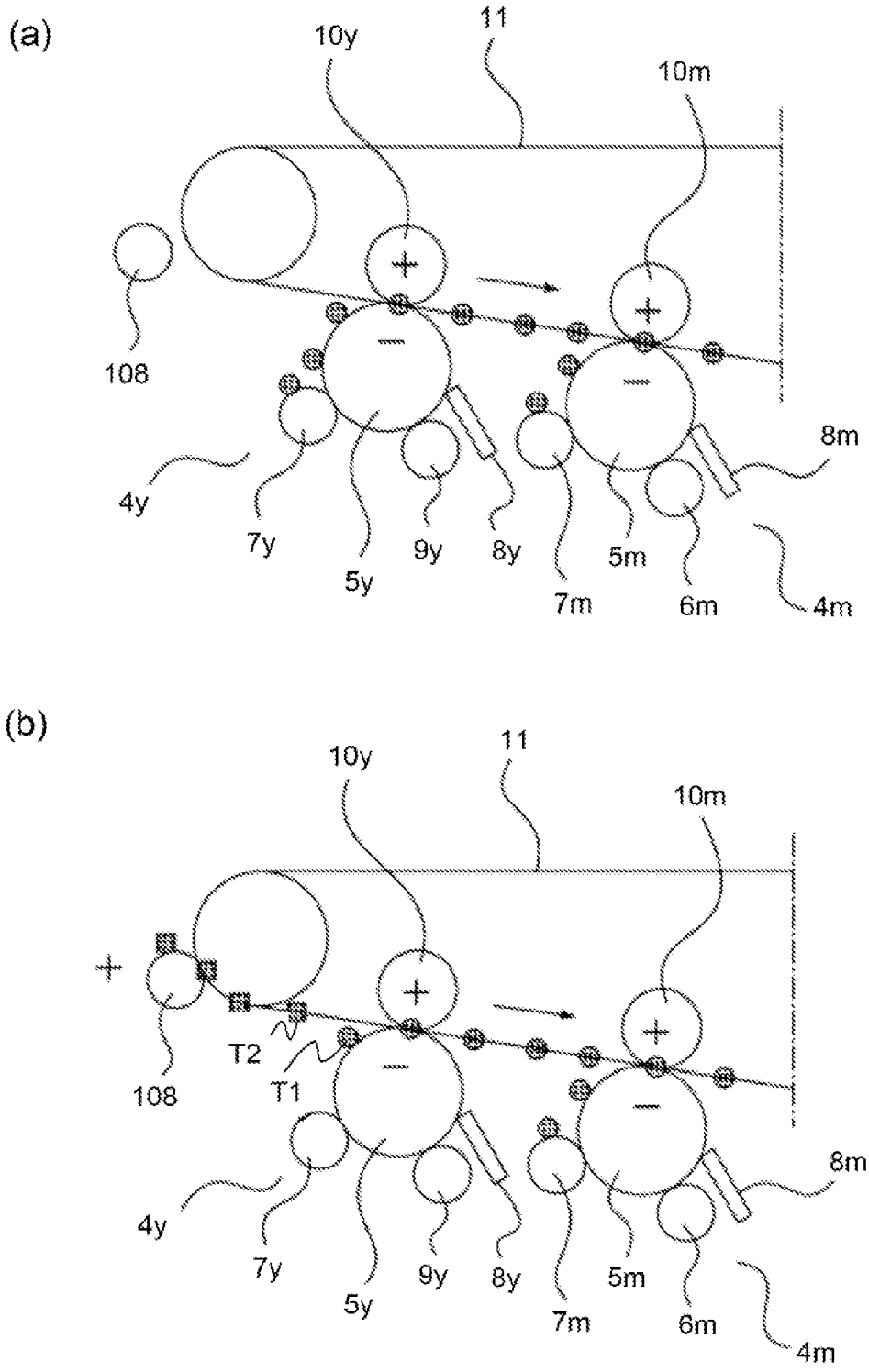
FIG. 5 illustrates flow of the toner image and the untransferred toner during continuous image formation.
Figure 6:
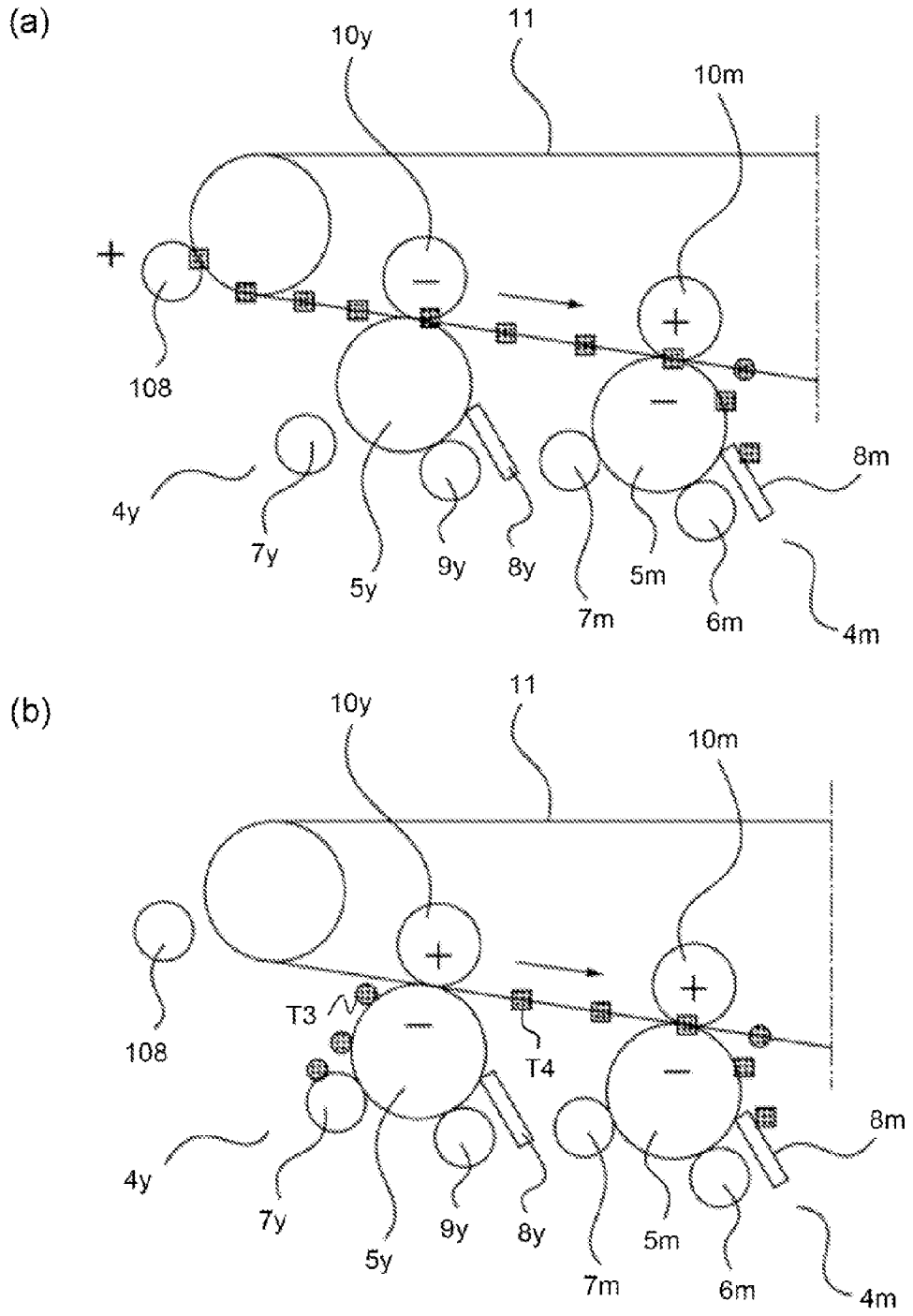
FIG. 6 illustrates flow of the toner image and the untransferred toner during continuous image formation.

The description will be made as to the operation of collecting untransferred toner into the toner cartridge 4*m*-4*k* other than the toner cartridge 4*y* that is located the upstreammost position, during continuous image formation. FIGS. 5 and 6 illustrate the flow of the toner image and the untransferred toner during the continuous image formation. In FIGS. 5, 6, the toner particles for image formation are indicated by circles, and the untransferred toner particles are indicated by squares.

As shown in part (a) of FIG. 5, in the primary transfer of the toner image, the image is developed on the photosensitive drums 5*y*, 5*m*, and the primary transfer is carried out in the primary transfer portion where the intermediary transfer belt 11 contacts photosensitive drums 5*y*, 5*m*. At this time, the charging roller 108 is spaced from the intermediary transfer belt 11, so that the untransferred toner is not discharged.

As shown in part (b) of FIG. 5, when the trailing edge T1 of the toner image is subjected to the primary transfer, the charging roller 108 is supplied with the positive bias voltage and is contacted to the intermediary transfer belt 11. By this, the untransferred toner moves from the charging roller 108 to the intermediary transfer belt 11 in the state that it is charged to the positive polarity.

The primary transfer operation continues until the trailing edge T1 of the toner image reaches the primary transfer nip, but the area after the trailing edge of the image on the photosensitive drum 5*y* does not have an electrostatic latent image, and therefore, no development occurs. Therefore, the untransferred toner is discharged at such timing that the trailing edge T1 of the developed toner image is not overlapped with a leading end T2 of the discharged untransferred toner.

As shown in part (a) of FIG. 6, between adjacent images where the primary transfer of the toner image is not carried out, the charging device 6*y* does not charge the photosensitive drum 5*y*. And, the negative bias voltage is applied to the primary transfer roller 10*y*. The untransferred toner discharged onto the intermediary transfer belt 11 is charged to the positive polarity, and therefore, when the untransferred toner reaches the primary transfer nip, it does not move to the photosensitive drum 5*y* but remains carried on intermediary transfer belt 11 and moves to the downstream. In order to prevent the toner from moving to the photosensitive drum 5*y* from the developing roller 7*y* at this time, the developing roller 7*y* is spaced from the photosensitive drum 5*y*.

Thereafter, the untransferred toner having reached the photosensitive drum 5*m* is moved to the photosensitive drum 5*m* by the potential difference between the positive bias voltage applied to the primary transfer roller 10*m* and the surface potential of the photosensitive drum 5*m* charged to the negative polarity by the charging device 6*m*. It is then scraped by the photosensitive member cleaning blade 8*m* and is collected into the toner cartridge 4*m*.

As shown in part (b) of FIG. 6, immediately before the primary transfer of the leading end T3 of the toner image, the charging roller 108 is spaced of the timing before the leading end T3 of the developed toner image reaches the primary transfer nip formed by the primary transfer roller 10*y* and the photosensitive drum 5*y*. Then, the discharging of the untransferred toner is stopped. By this, the trailing edge T4 of the discharged untransferred toner is not overlapped with the leading end T3 of the developed toner image. The surface of the photosensitive drum 5*y* is charged to the negative polarity by the charging device 6*y*, and the toner is deposited by the developing roller 7*y* to develop into the toner image and is transferred by the primary transfer.

The operations of FIGS. 5, 6 are controlled by a controller B (FIG. 1). By repeating the operations, the untransferred toner is collected into the toner cartridge 4*m* other than the upstreammost toner cartridge 4*y* during continuous image formation. In the foregoing, the collection is made into the toner cartridge 4*m*. For the other toner cartridge, the untransferred toner is collected into the toner cartridge 4*c* which is relatively downstream. Similarly, the collection into the toner cartridge 4*k* can be carried out.

As described in the foregoing, in this embodiment, the untransferred toner on the intermediary transfer belt 11 is removed by the cleaning blade 101, and the untransferred toner is discharged onto the intermediary transfer belt 11 by the charging roller 108. Thus, the cleaning function and the discharging function are separated, so that it is unnecessary to temporarily stop the continuous image formation, which is advantageous.

In addition, the cleaning blade 101 is made of rubber which is elastic member, and therefore, the contactness relative to the intermediary transfer belt 11 is improved so that the untransferred toner on the intermediary transfer belt 11 can be assuredly removed.

In addition, when the untransferred toner is plastered into a thin layer by the toner regulating member 109, the foreign matter can be simultaneously removed, and therefore, the discharging of the foreign matter onto the intermediary transfer belt 11 can be suppressed, so that the possible damage to the surface of the photosensitive drum 5 and the resulting image defect can be avoided.

Since the untransferred toner is collected into the toner cartridge 4*y*-4*k* finally, it is not necessary for the user to periodically exchange the untransferred toner collection container (accommodating portion 105) provided in the image forming apparatus.

In addition, the charging roller 108 is spaced and contacted relative to the intermediary transfer belt 11. The discharging from the charging roller 108 is carried out such that while the toner image formed on the photosensitive drum 5*y* is not in the primary transfer nip formed by the photosensitive drum 5*y* and the primary transfer roller 10*y*, the untransferred toner exists in the primary transfer nip. By doing so, the untransferred toner can be collected into the toner cartridges 4*m*-4*k* other than the toner cartridge 4*y* during the continuous image formation, and therefore, the upsizing of the toner cartridges 4*y*-4*k* or the image forming apparatus 1 can be suppressed.

Second Embodiment

An image forming apparatus and a toner cleaning device for the image forming apparatus according to a second embodiment of the present invention will be described. In the description of this embodiment, the same reference numerals as in Embodiment 1 are assigned to the elements having the corresponding functions in this embodiment, and the detailed description thereof is omitted for simplicity.

Figure 7:
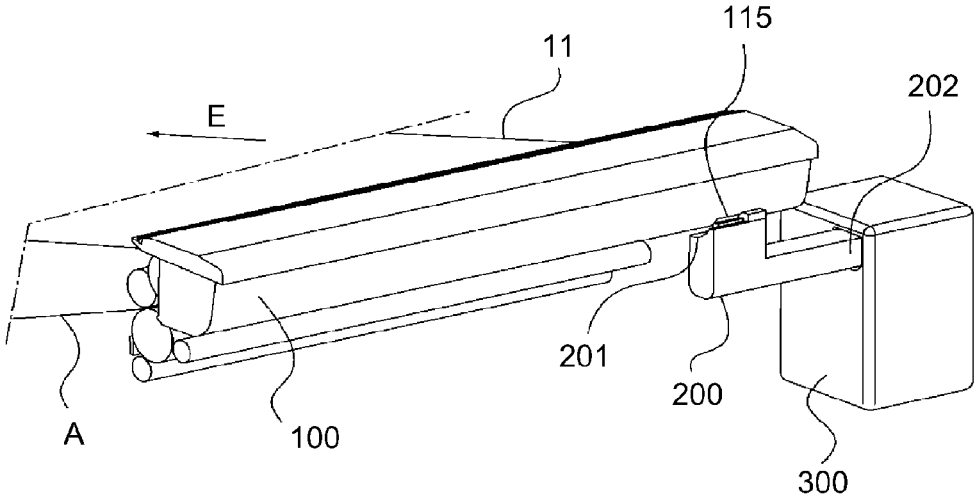
FIG. 7 is an illustration of a cleaning unit, a toner feeding unit and a collection container according to a second embodiment of the present invention.

FIG. 7 is an illustration of a toner cleaning device 100, a toner feeding unit 200 and a collection container 300 according to this embodiment. As shown in FIG. 7, the image forming apparatus 1 of this embodiment comprises the image forming apparatus 1 of the first embodiment, the toner feeding unit 200 and the collection container 300.

The toner feeding unit 200 receives the untransferred toner from the toner cleaning device 100, and feeds the untransferred toner to the collection container 300. The toner feeding unit 200 is provided in the main assembly side of the image forming apparatus, separably from the intermediary transfer unit A.

The intermediary transfer unit A is insertable into and removable from the image forming apparatus 1 in the direction of arrow E in FIG. 7. A discharge opening 115 of the toner cleaning device 100 and a toner inlet port 201 of the toner feeding unit 200 are connected with each other. The untransferred toner brought into the inlet port 201 is fed into the discharge opening 202 of the toner feeding unit 200 and falls into the collection container 300.

Figure 8:
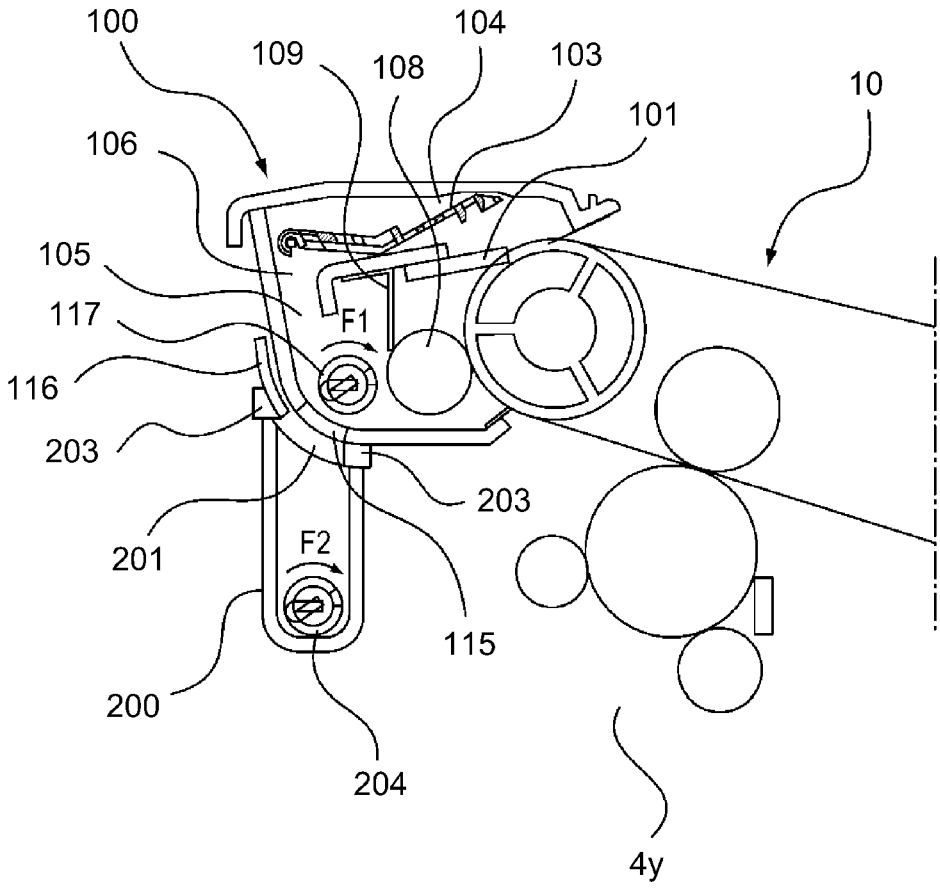
FIG. 8 is a sectional view of the cleaning unit and the toner feeding unit according to the second embodiment.

As shown in FIG. 8, the toner cleaning device 100 includes a shutter 116 and a toner feeding screw 117. The shutter 116 is provided below the discharge opening 115 to open and close the discharge opening 115. The toner feeding screw 117 is rotated in a predetermined direction (arrow F1) by driving means such as a motor (unshown) to feed the untransferred toner to the discharge opening 115 and into the inlet port 201.

When the intermediary transfer unit A is mounted and demounted in the exchanging operation or the like, the shutter 116 is closed to close the discharge opening 115. By doing so, the leakage of the untransferred toner resulting in the contamination of the inside of the image forming apparatus can be suppressed.

When the intermediary transfer unit A is mounted to the image forming apparatus, the shutter 116 is opened so that the discharge opening 115 and the inlet port 201 are connected to each other. In order to prevent the leakage of the toner through the gap between the discharge opening 115 and the inlet port 201, the peripheral circumference of the inlet port 201 is covered by a sealing member 203. The sealing member 203 is made of elastic member such as polyurethane.

The driving system for the toner feeding screw 117 is independent from that for the charging roller 108, and they can be rotated independently from each other. Therefore, the charging roller 108 and the toner feeding screw 117 can be switched at any timing.

The toner feeding unit 200 is provided with a toner feeding member 204. The untransferred toner discharged from the discharge opening 115 falls and is then introduced to the toner feeding member 204, and is fed toward the discharge opening 202 from the inlet port 201 by rotating the toner feeding member 204 in the predetermined direction (arrow F2). The untransferred toner fed to the discharge opening 202 is sequentially accommodated into the collection container 300.

According to this embodiment, the controller B can switch the operation between the untransferred toner collection by the discharging from the charging roller 108 and the untransferred toner collection by the toner feeding screw 117 provided in the accommodating portion 105. More particularly, the untransferred toner is discharged to the intermediary transfer belt 11 by the charging roller 108 to reduce the amount of the untransferred toner in the accommodating portion 105. The foreign matter such as the paper dust, the dust, the fuzz or the like removed by the toner regulating member 109 contacting the charging roller 108 and accommodated in the accommodating portion 105 is fed into the collection container 300 provided in the image forming apparatus side. By doing so, the accommodating portion 105 does not become filled with such foreign matter, and the untransferred toner can be transported smoothly to the charging roller 108 until the end of the service life of the image forming apparatus.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 039547/2011 filed Feb. 25, 2011 which is hereby incorporated by reference.

What is claimed is:

1. An image forming apparatus comprising:
- an image bearing member for carrying a toner image;
- a rotatable endless intermediary transfer member; and
- a cleaning unit for removing the toner deposited on said intermediary transfer member,
- wherein said cleaning unit includes:
  - a scraping member for removing the toner deposited on said intermediary transfer member from said intermediary transfer member,
  - an accommodating portion for accommodating the toner removed by said scraping member,
  - a discharging member, contacted with said intermediary transfer member and disposed downstream of said scraping member with respect to a movement direction of said intermediary transfer member, for moving the toner accommodated in said accommodating portion to said intermediary transfer member by application of a voltage, and
  - a regulating member contacted to said discharging member to regulate an amount of the toner deposited on said discharging member.

2. An apparatus according to claim 1, further comprising a cleaning power source for applying a voltage to said discharging member, said cleaning power source is capable of applying a voltage of a polarity opposite a regular charge polarity of the toner.

3. An apparatus according to claim 1, wherein said scraping member includes an elastic blade.

4. An apparatus according to claim 1, wherein said regulating member contacts a surface of said discharging member to regulate a thickness of a toner layer deposited on said discharging member and to remove foreign matter from said discharging member.

5. An apparatus according to claim 1, further comprising a feeding member for feeding the toner removed by said scraping member.

6. An apparatus according to claim 1, wherein the toner discharged from said discharging member to said intermediary transfer member is moved from said intermediary transfer member to said image bearing member in a primary transfer portion formed by said image bearing member and said intermediary transfer portion, and then is removed from said image bearing member by an image bearing member cleaner for collecting the toner.

7. An apparatus according to claim 1, wherein said intermediary transfer member includes an intermediary transfer belt rotated by a driving roller.

8. An apparatus according to claim 7, wherein said discharging member includes a roller rotatable by receiving power from said driving roller at the same speed as said intermediary transfer belt.

9. An apparatus according to claim 8, wherein said roller is provided with a core metal and an electroconductive layer contacted by said regulating member.

10. An apparatus according to claim 1, further comprising a contacting and spacing portion contacting and spacing said discharging member relative to said intermediary transfer member.

11. An apparatus according to claim 10, wherein said discharging member discharges the toner to said intermediary transfer member at such timing that the toner discharged onto said intermediary transfer member and a toner image transferred onto said intermediary transfer member by said primary transfer from said image bearing member are not overlapped with each other.

12. An apparatus according to claim 1, further comprising a feeding member, provided in said accommodating portion, for feeding the toner and foreign matter removed by said regulating member, and a collection container for collecting the toner and the foreign matter fed by said feeding member.

13. An apparatus according to claim 1, further comprising a primary transfer device for primary transfer of the toner image from said image bearing member onto said intermediary transfer member.

14. An apparatus according to claim 1, further comprising a secondary transfer device for secondary transfer of the toner image from said intermediary transfer member onto a sheet.

* * * * *